US006021615A

United States Patent [19]

Brown

[11] Patent Number: 6,021,615

[45] Date of Patent: Feb. 8, 2000

[54] WOOD FLOORING PANEL

[76] Inventor: Arthur J. Brown, P.O. Box 309, Red Creek, N.Y. 13413

[21] Appl. No.: 09/195,499

[22] Filed: Nov. 19, 1998

[51] Int. Cl.[7] ..... E04F 13/08

[52] U.S. Cl. ..... 52/392; 52/391; 52/591.5; 52/592.2; 428/167

[58] Field of Search ..... 52/390–392, 403.1, 52/589.1, 290, 591.5, 592.1, 592.2; 428/167

[56] References Cited

U.S. PATENT DOCUMENTS

| | | | |
|---|---|---|---|
| 548,657 | 10/1895 | Ransome | 52/390 |
| 801,108 | 10/1905 | Romanoff | 52/390 |
| 1,532,504 | 4/1925 | Lichtenfeld . | |
| 2,006,635 | 7/1935 | Farr | 52/391 |
| 3,436,888 | 4/1969 | Ottosson | 52/480 |
| 3,717,247 | 2/1973 | Moore | 206/59 F |
| 3,740,911 | 6/1973 | O'Leary | 52/388 |
| 3,905,172 | 9/1975 | Blackburn | 52/741 |
| 4,047,344 | 9/1977 | Postman et al. | 52/390 |
| 4,090,338 | 5/1978 | Bourgade | 52/392 |
| 4,471,012 | 9/1984 | Maxwell | 428/106 |
| 4,796,402 | 1/1989 | Pajala | 52/390 |
| 4,953,335 | 9/1990 | Kawaguchi et al. | 52/384 |
| 5,058,349 | 10/1991 | Conrad | 52/392 |
| 5,103,614 | 4/1992 | Kawaguchi et al. | 52/392 |
| 5,283,102 | 2/1994 | Sweet et al. | 428/167 |
| 5,830,549 | 11/1998 | Sweet et al. | 428/40.1 |
| 5,894,700 | 4/1999 | Sweet | 52/391 |

*Primary Examiner*—Christopher Todd Kent
*Assistant Examiner*—Yvonne Horton Richardson
*Attorney, Agent, or Firm*—Trapani & Molldrem

[57] ABSTRACT

Wood flooring panel is made of a plurality of parallel longitudinal wood slats situated side by side, with the slats being of the same length but staggered in their longitudinal positions. A tambour backing is adhesively secured to a back side of the slats to hold the slats together as a panel. The tambour backing is made of a material that is inextensible in the longitudinal and lateral directions, but flexible to permit bending at joints defined between said wood slats. There are clips or tabs affixed onto the back surfaces of the respective slats at the front ends. These extend about a half-inch beyond the forward ends of the respective slats. The tambour can be secured with a hot melt adhesive. The clips can be formed of rectangles of fish paper. The clips prevent the flooring adhesive from coming between the front ends of the slats of one panel slats and the rear ends of the next panel slats. The clips also help align the ends of the corresponding slats or fingers of the two panels.

11 Claims, 3 Drawing Sheets

WOOD FLOORING PANEL

BACKGROUND OF THE INVENTION

This invention relates to wood flooring, and is more particularly concerned with flooring surfaces in the form of hardwood tiles or panels that can be adhesively applied onto a subflooring of concrete or other materials.

Wood floor coverings and hardwood floors in particular have been expensive to construct and to install, and it has long been sought to find a suitable technique for the economical fabrication of attractive, durable floors. In particular, the industry has long sought a flooring technique that is suited for public areas, such as retail stores, restaurants, office spaces, or the like, where hardwood or other similar flooring surface is desired. It has also been desired to achieve the speedy and cost effective installation of hardwood flooring directly onto a concrete subfloor, using a conventional flooring adhesive, and which can provide a random-length appearance.

A number of flooring techniques have been proposed, but none of these achieve the ends of this invention. Kawayashi et al. U.S. Pat. No. 5,103,414 and Conrad U.S. Pat. No. 5,058,349 describe flooring systems in which hardwood strips are combined into tiles or panels. Another prefabricated flooring system is described in Moore U.S. Pat. No. 3,717,247. Parquet flooring tiles are discussed in Bourgade U.S. Pat. No. 4,090,338 and Ottosson U.S. Pat. No. 3,436,888. A hardwood flooring system that can create a random look is described in Blackburn U.S. Pat. No. 3,905,172. None of the previously proposed hardwood floor systems creates a floor with the look of random slat lengths, with the convenience of an adhesive installation and with the durability of tongue and groove.

OBJECTS AND SUMMARY OF THE INVENTION

Accordingly, it is an object of this invention to provide an attractive flooring system that installs easily and securely, and avoids the drawbacks of the prior art.

It is another object to provide a flooring system employing tiles or panels that can be installed using a conventional flooring adhesive, but which is formed of longitudinal wood slats and creates the appearance of hardwood floorboards.

In accordance with an aspect of the present invention, a wood flooring panel is provided for installing on a substrate, i.g., concrete floor space. A number of parallel longitudinal wood slats or fingers are situated side by side. Each slat or finger has back and face surfaces, left and right sides, a front end and a rear end, and the slats are all of the same length, but staggered in their longitudinal positions. A tambour backing is adhesively secured to a back side of the array of slats to hold the slats together as a panel. The tambour backing is made of a suitable material that is inextensible in the longitudinal and lateral directions, but flexible to permit bending at joints defined between the wood slats. Clips or tabs are affixed onto the back surfaces of the respective slats or fingers at their front ends, and extend sightly beyond the forward ends of the respective slats.

Preferably, the tambour backing is a durable tambour paper and is adhered to the slats by means of a hot-melt adhesive. In a preferred embodiment, the tabs are formed of rectangles of fish paper. The slats have tongues formed at said front ends and mating grooves formed at the rear ends thereof. The rightmost slat and leftmost slat of the panel may have a tongue (i.e., ridge) formed on an outer edge of one and a mating groove formed in an outer edge of the other. The longitudinal edges of the slats, with the exception of the outer edges of the rightmost and leftmost slats, are flush or plane, i.e., without tongue or groove.

In a preferred mode, the slats are made of three or more plies, with top and bottom plies being of wood of the same species, so as to prevent warping. Alternatively, the slats are made of a synthetic material formed of recycled forest product material, e.g., recycled paper mixed with a soybean paste.

The a hardwood floor can be installed, employing a series of wood flooring panels, each panel comprised of a plurality of parallel longitudinal wood slats, a tambour backing, and tabs as discussed hereinabove. The flooring can be installed by preparing a flat horizontal floor space; applying a flooring adhesive onto the floor space; laying one panel onto the flooring adhesive on the floor space; and laying another panel in end to end relation with the first panel such that rear ends of the slats or fingers of the successive panel are placed over the tabs or clips of the first panel, with corresponding rear ends of the second panel slats fitting against the respective front ends of the first panel slats. Successive panels are installed in this fashion. The panels are installed in successive rows by laying an adjacent panel onto the floor space with a leftmost slat of one of the first panel and the adjacent panel in side by side relation with the rightmost slat of the other of the panels. The tongue structure on one edge can fit the groove structure on the other edge of the adjacent panel. This is continued until the floor space is covered. Preferably, the adjacent panel position is staggered in relation to the position of the first panel.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
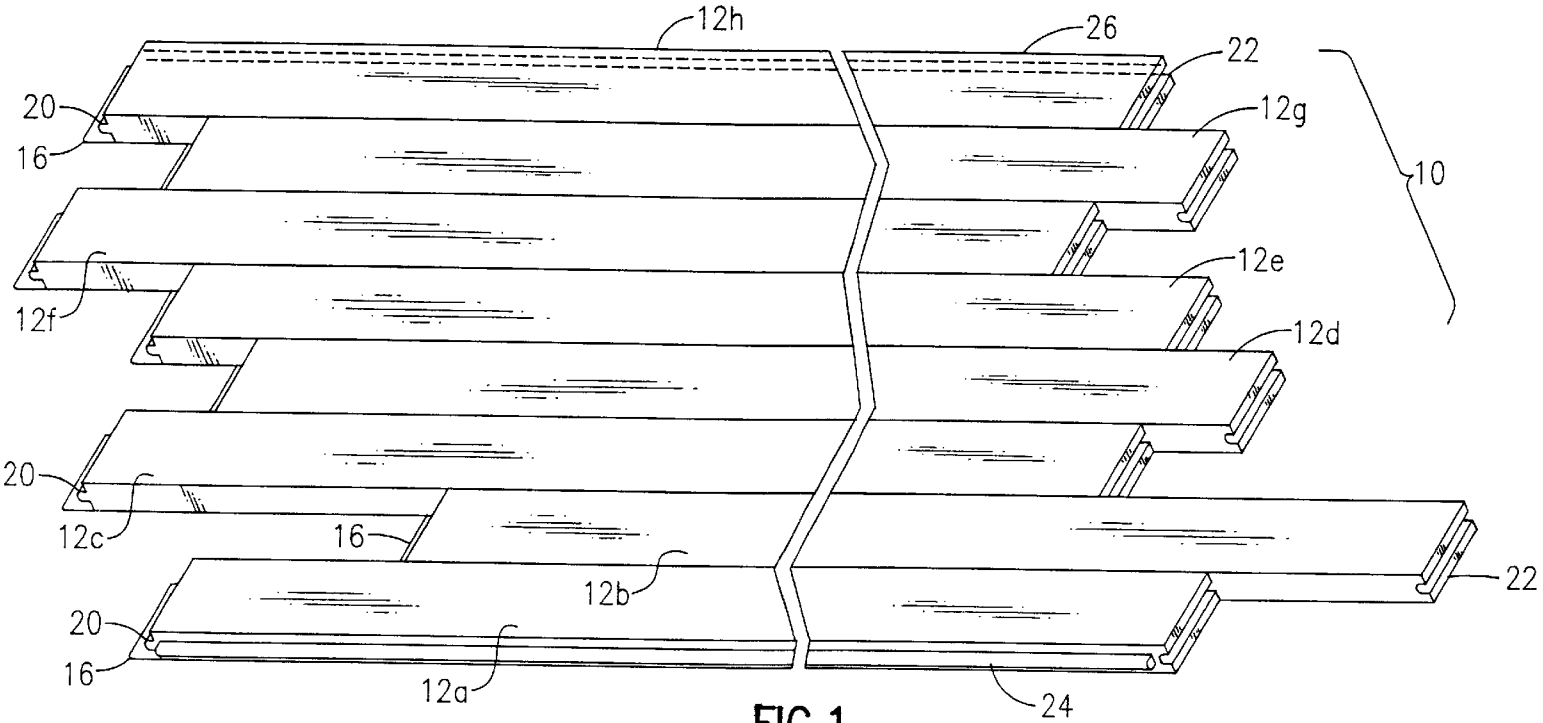
FIG. 1 is a perspective view of a wood flooring panel according to an embodiment of this invention.
Figure 2:
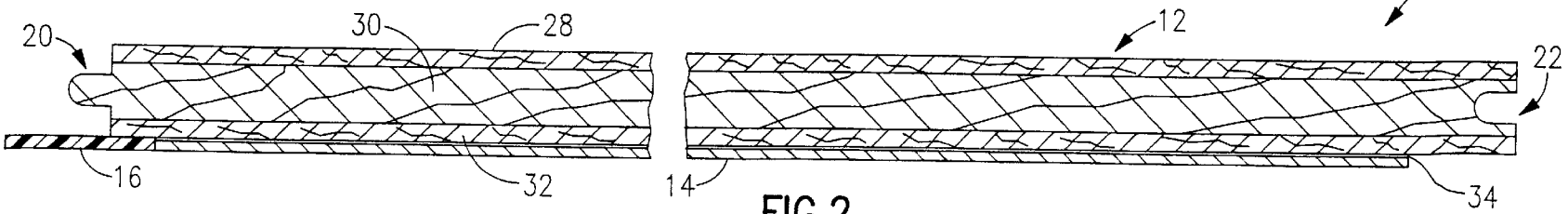
FIG. 2 is a cross sectional view of this embodiment.
Figure 3:
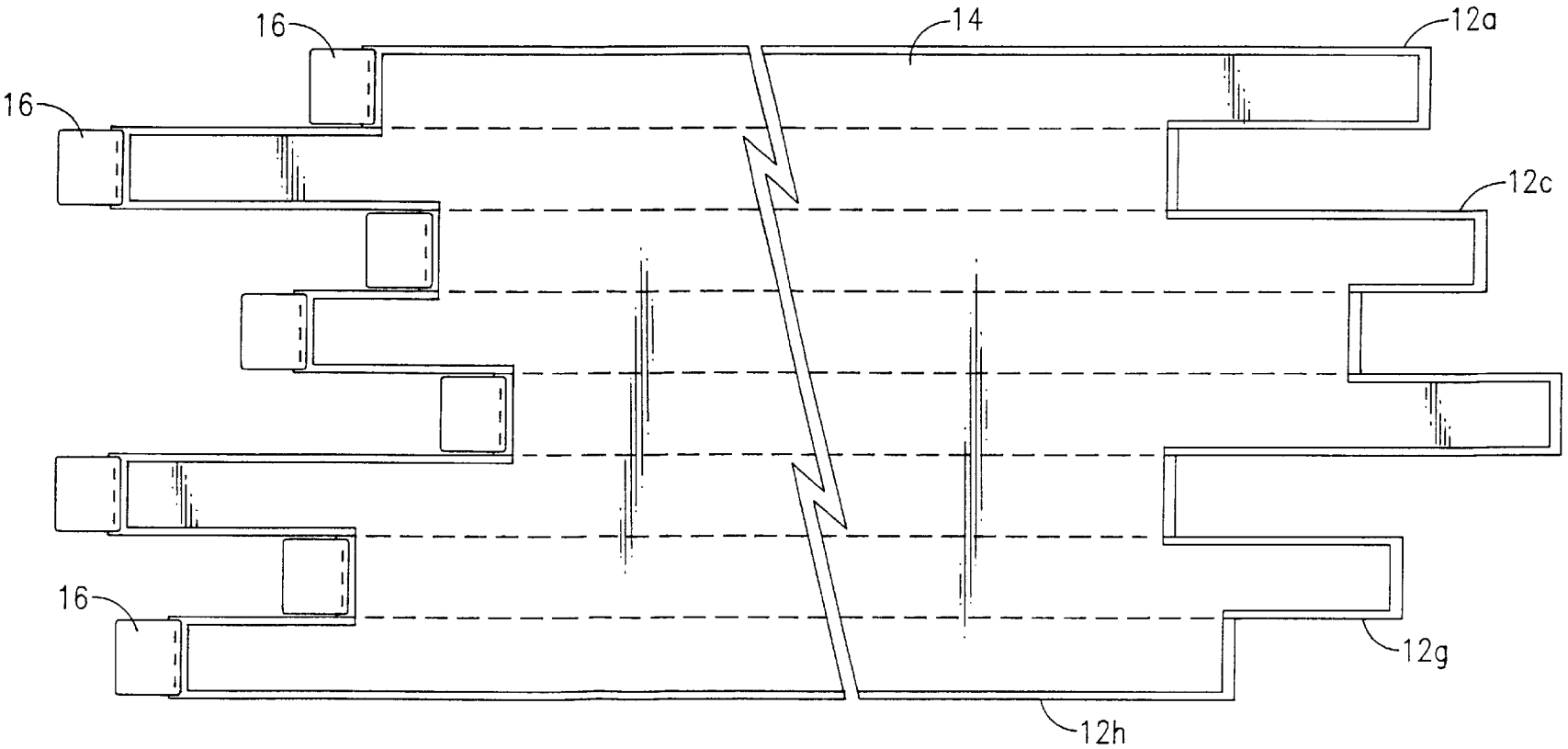
FIG. 3 is a bottom plan view of this embodiment.

With reference to the Drawing, FIGS. 1 to 3 illustrate a hardwood flooring panel 10 The panel 10 is comprised of eight wood slats or fingers 12*a* to 12*h*, with slat 12*a* being the leftmost slat and slat 12*h* being the rightmost slat. Here, each slat 12*a* to 12*h* is 96 inches in length, three inches in width, and three-eighths inch thick. The slats are all secured onto a tambour backing 14, formed of tambour paper of the type purchased from Kimberly Clark, here of 10½ mils thickness. The tambour paper 14 has the characteristic that it is inextensible in either the length or width dimensions, but can be bent or flexed.

The ends of the slats are staggered, so as to create an uneven joint between two panels, when the two panels are joined end to end. Clips, i.e., flat tabs 16 are affixed on the underside of each of the slats or fingers 12*a* to 12*h*, at the front or forward ends thereof. These clips 16 are preferably made of fish paper, a material which is often used as a tough electrical insulator. These are rectangles of about one inch by three inches, and project about one-half inch forward of the front end of each slat. The fish paper material is preferred because it is flexible and durable, but will not cut the fingers of an installer. The clips 16 serve the purpose of keeping flooring adhesive out of the joints between two panels, and helps align the eight fingers or slats 12*a* to 12*h* at the end of the panel 10. The clips or tabs 16 can be stapled on (see FIG. 3).

The slats 12 each have tongue and groove construction at their ends, with a tongue or bead 20 formed at the front end, i.e., the same end as the tab or clip 16, and with a mating groove 22 formed at its other, or rear end. The tongue and the groove of successive panels interlock in known fashion.

As shown in FIG. 1, a tongue or bead 24 is formed along the outer edge of the leftmost slat 12*a*, and a groove 26 (illustrated in ghost) is formed in the outer edge of the rightmost slat 12*h* of each panel.

The slats or fingers can be made of solid hardwood or of another suitable wood. Alternatively, a composite material may be used, made of composite wood, paper, or other forest product material. An example of this is a synthetic granite made of recycled paper mixed with a soybean paste. The terms "wood" and "hardwood" are meant to include any material that would be suited as a flooring slat or strip, and which can be cut and milled using woodworking tools and equipment.

In the preferred embodiment illustrated in FIG. 2, the slat 12 is made of multiple plies of hardwood. Here three plies are shown, but any number of plies can be used. There is a top or face ply 28, a center ply or core 30, and a bottom or back ply 32. Preferably, the top and bottom plies 28 and 32 are made of wood of the same species, so as to minimize warping of the wood. The core can also be of the same species.

A hot melt glue bond 34 secures the tambour backing 14 onto the bottom face or ply 32 of the slat 12.

As shown in FIG. 1, the edges of all the slats 12, other than the outer edges of the slats 12*a* and 12*h*, are planar or flush, i.e., provided without tongue or groove. This is seen, e.g., on the exposed edges of slats 12*b* and 12*c*.

The panels 10 of this invention are easily fabricated in the factory. The tambour backing 14 is preglued with the hot melt adhesive 34, and is cut to shape, i.e., as shown in FIG. 3. The slats are arranged side by side in a jig or template (not shown), with the bottom faces up, and the tarnbour backing laid in place on this assembly. Then the assembly is passed, in this inverted orientation, beneath an array of heaters, which heat the tambour and the hot melt glue to just above its melting temperature of 300 degrees F. The panel then passes through a pair of press rollers, and the hot melt glue cools to bond the tambour to the slats. After this, the clips or tabs 16 are secured onto the front ends of the slats or fingers.

Figure 4:
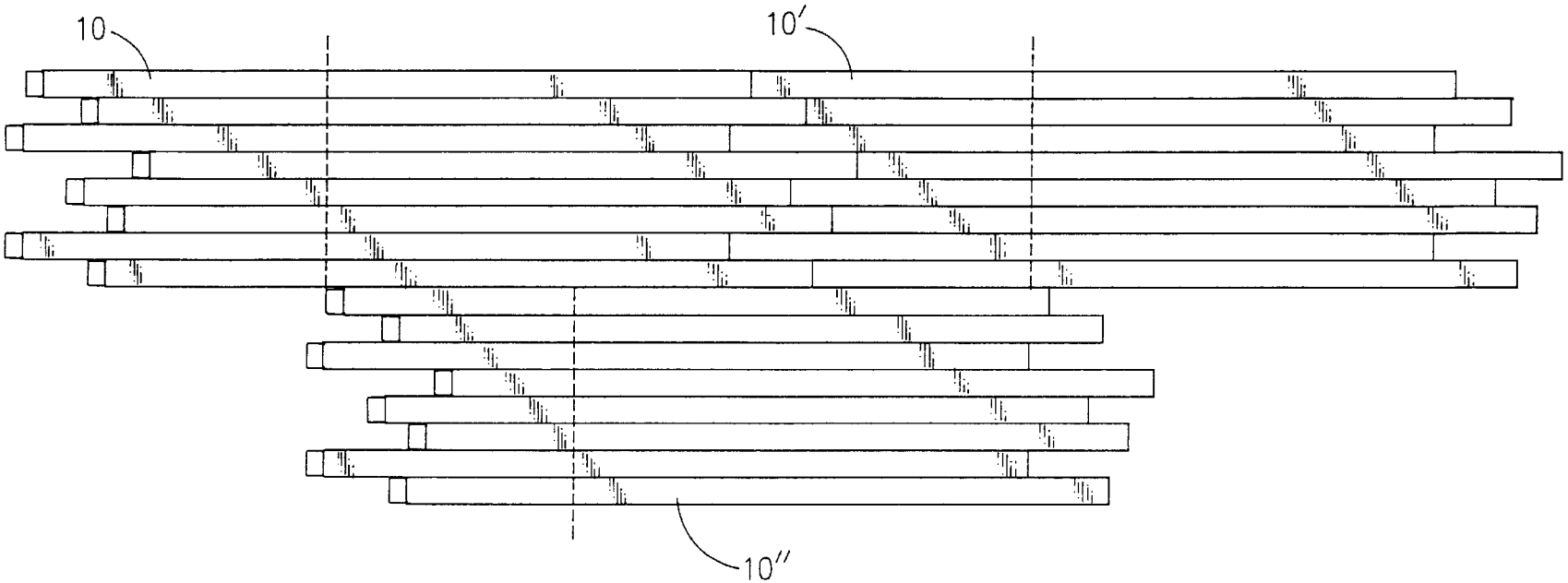
FIG. 4 is a schematic view for explaining the installation of the wood flooring panels of this embodiment.

The flooring system of this invention can be easily and quickly installed, with a minimum of crew. First, the subfloor or base is prepared. In the case of a concrete floor space, this may include repairing cracks and applying mortar or other material to smooth out any uneven areas. A standard flooring adhesive is be applied onto the floor space. Good results have been achieved using "Bostik's Best" or "Bostik Fast-Tack" adhesives, which are readily available. Then the wood flooring panels are laid onto the adhesive on the floor space. As shown in FIG. 4, after a first panel 10 has been installed, then a second panel 10' is joined to it, end-to-end. The grooves 22 of the second panel 10' fit onto the tongues 20 of the first panel. The clips or tabs 16 prevent the flooring adhesive from coming between the front end of the first panel slats and the rear ends of the second panel slats. The clips also help align the ends of the corresponding slats or fingers of the two panels 10 and 10'. Additional panels are installed in this fashion across the floor space. Partial length panels are placed at the ends to meet against the walls or edges of the floor space.

An adjacent panel 10" is installed side by side, but staggered, as shown, with respect to the panels 10 and 10'. This increases the randomness or unevenness in the ends of the slats, to enhance the random look of the flooring. The installation is continued in this fashion until the floor space is covered. A final row may require partial-width panels. These may be cut or sawed using standard wood saws or woodworking tools.

These flooring materials are easily transported to the job site, and are easily installed, typically with a labor savings of 35% to 45% below other flooring materials. On the other hand, because of the randomness or arbitrary staggering of the ends of the slats, the finished floors have a traditional hardwood floor appearance. The floors are durable and easily withstand the foot traffic typical of retail stores and similar environments.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

I claim:

1. Wood flooring panel, comprising a) a plurality of parallel longitudinal wood slats situated side by side, each said slat having back and face surfaces, left and right sides, a front end and a rear end, and said slats being of the same length but staggered in their longitudinal positions, b) a tambour backing adhesively secured to a back side of said slats to hold the slats as a panel, with said tambour backing being of a material that is inextensible in the longitudinal and lateral directions, but flexible to permit bending at joints defined between said wood slats, and c) tabs affixed onto the back surfaces of the respective slats at the front ends thereof and extending sightly beyond the forward ends of the respective slats.

2. Wood flooring panel according to claim 1 wherein said tambour backing is adhered to said slats by means of a high-melt adhesive.

3. Wood flooring panel according to claim 1 wherein said tabs are formed of rectangles of fish paper.

4. Wood flooring panel according to claim 1 wherein said slats have tongues formed at said front ends and mating grooves formed at the rear ends thereof.

5. Wood flooring panel according to claim 1 wherein said panel has a rightmost slat and a leftmost slat, with one of said rightmost and leftmost slats having a tongue formed on an outer edge thereof, and the other of the rightmost and leftmost slats having a mating groove formed in an outer edge thereof.

6. Wood flooring panel according to claim 5 wherein the longitudinal edges of said slats, with the exception of said outer edges of said rightmost and leftmost slats, are flush and without tongue or groove.

7. Wood flooring panel according to claim 1 wherein said slats are made of three or more plies, with top and bottom plies being of wood of the same species.

8. Wood flooring panel according to claim 1 wherein said slats are made of a synthetic material formed of recycled forest product material.

9. Wood flooring panel according to claim 8 wherein said slats are made of recycled paper mixed with a soybean paste.

10. Method of installing a hardwood floor formed of a series of wood flooring panels, each panel comprising a plurality of parallel longitudinal wood slats situated side by side each said slat having back and face surfaces, left and right sides, a front end and a rear end, and said slats being of the same length but staggered in their longitudinal positions; a tambour backing adhesively secured to a back side of said slats to hold the slats as a panel, with said tambour backing being of a material that is inextensible in the longitudinal and lateral directions, but flexible to permit bending at joints defined between said wood slats; and tabs affixed onto the back surfaces of the respective slats at the front ends thereof and extending sightly beyond the forward ends of the respective slats; the method including preparing a flat horizontal floor space;

applying a flooring adhesive onto said floor space;

laying one said panel onto the flooring adhesive on said floor space;

laying a successive such panel in end to end relation with the first-mentioned panel such that rear ends of the slats of the successive panel are place over the tabs of the first-mentioned panel, with corresponding rear ends fitting against the respective front ends of the slats of the first-mentioned panel; and laying an adjacent such panel onto said floor space with a leftmost slat of one of the first-mentioned panel and said adjacent panel in side by side relation with the rightmost slat of the other of the first-mentioned and adjacent panels.

11. The method of installing a hardwood floor according to claim 10, wherein the step of laying said adjacent panel includes staggering the position of the adjacent panel with respect to the first-mentioned panel.

* * * * *